United States Patent [19]

Kraemer et al.

[11] Patent Number: 4,586,771

[45] Date of Patent: May 6, 1986

[54] CONNECTOR ASSEMBLY HAVING CAMMING SYSTEM FOR MATING AND UNMATING

[75] Inventors: Rudolf E. Kraemer, Lautertal; Werner Moritz, Kleinostheim, both of Fed. Rep. of Germany

[73] Assignee: AMP Incorporated, Harrisburg, Pa.

[21] Appl. No.: 707,625

[22] Filed: Mar. 4, 1985

[51] Int. Cl.[4] ..... H01R 13/629

[52] U.S. Cl. ..... 339/75 MP; 339/75 M

[58] Field of Search ..... 339/75 M, 75 MP, 90 R

[56] References Cited

U.S. PATENT DOCUMENTS

| | | | |
|---|---|---|---|
| 3,392,245 | 7/1968 | Asick | 339/75 M |
| 4,332,432 | 6/1982 | Colleran | 339/75 M |
| 4,344,663 | 8/1982 | Ognier et al. | 339/75 M |

*Primary Examiner*—John McQuade

*Attorney, Agent, or Firm*—Frederick W. Raring; Thomas G. Terrell

[57] ABSTRACT

Connector assembly comprises first and second connector housings and a camming slide for mating and unmating the housings. The first housing has flanges extending from the mating face thereof and has slots in the flanges which receive cam followers on the cam slide. The second housing has cam tracks in its sidewalls which also receive the cam followers. The camming slide is generally U-shaped and has a web which is spaced from the rear face of the second housing and arms which extend from the web across the sidewalls of the second housing and which overlap the flanges on the first housing. The cam followers project from the internal surfaces of the arms and extend through the slots and are dimensioned to be received in the camming slots on the second housing.

8 Claims, 6 Drawing Figures

CONNECTOR ASSEMBLY HAVING CAMMING SYSTEM FOR MATING AND UNMATING

FIELD OF THE INVENTION

This invention relates to electrical connector assemblies of the type comprising first and second connector housings and a camming slide for mating and unmating the housings.

BACKGROUND OF THE INVENTION

U.S. Pat. No. 3,392,245 describes an electrical connector assembly comprising first and second connector housings and a camming slide comprising an open rectangular frame which surrounds the housings. The camming slide is slidably mounted on one of the housings for movement in a direction which extends perpendicularly with respect to the path of movement of the housings towards each other when they are mated and unmated. The camming slide also has cam tracks which receive cam followers on the second housing. The two housings can be mated with each other by positioning the cam followers on the second housing in the cam tracks of the camming slide and then moving the camming slide relative to the housings so that the cam tracks cause the second housing to move into mated relationship with the first housing.

The connector assembly shown in U.S. Pat. No. 3,392,245 cannot be used under certain circumstances because of the fact that the camming slide extends laterally beyond the connector housings and is moved when the connector housings are coupled or uncoupled between two extreme positions. It follows that clearance must be provided for the movement of this slide in any connector assembly in which this type of coupling slide is used, and there are circumstances where there is not sufficient clearance to permit movement of the slide.

It would also be desirable to provide a connector assembly having a camming system for mating and unmating the connector parts of more simple construction than the system shown in the above-identified U.S. patent, and which could be produced at a cost which is not significantly greater than the cost of the connector assembly without the camming slide.

The present invention is directed to the achievement of a connector assembly having a camming slide which requires a minimum amount of space for the slide and which does not extend beyond the ends of the connector assembly. The invention is further directed to the achievement of a connector assembly having a camming system which can be manufactured at a cost only slightly greater than the cost of an assembly without a camming slide.

THE INVENTION

The invention comprises an electrical connector assembly of the type comprising first and second connector housings, each of which has a plurality of electrical terminals therein. The housings have mating faces which are opposed to each other when the connector housings are in the mated condition and have oppositely facing sidewalls and oppositely facing endwalls. The assembly has a camming system for moving the housings towards and away from each other along a first path to mate and unmate the housings, the camming system comprising a camming slide which is mounted on one of the housings and which is movable along a camming slide path which extends transversely of the first path. The connector assembly in accordance with the invention is particularly characterized in that the first housing has a pair of side flanges extending therefrom on opposite sides of the mating face. The side flanges have ends which are proximate to the endwalls of the first housing and have free edges extending between the ends of the flanges which are spaced outwardly from the mating face of the housing. The camming slide is U-shaped and comprises a web and spaced-apart arms extending from the web. The camming slide is mounted on the flanges with the arms extending towards and overlapping the flanges. The arms and the flanges have interfitting guides for guiding the cam slide along the camming slide path. The second housing has cam tracks in the sidewalls thereof which extend inwardly from the mating face. The cam tracks have intermediate portions which extend diagonally towards the rear face of the second housing and the arms have integral cam followers which are received in the cam tracks so that, upon positioning the second housing in opposed aligned relationship with the first housing with the cam followers in the cam tracks, the first and second housings can be mated to each other by moving the camming slide along the camming slide path.

In accordance with further embodiments, the web of the camming slide is located outwardly from the free edges of the flanges of the first housing and the second housing is located between the web and the first housing. The interfitting guides for guiding the camming slide along the cam slide path comprise, in one embodiment, slots in the flanges of the second housing through which the cam followers extend so that the cam followers are captured in these slots.

In accordance with a further embodiment, locating surfaces are provided on the camming slide and on the first housing for locating the second housing in alignment with the first housing in preparation for mating the housings with each other.

THE DRAWING FIGURES

THE DISCLOSED EMBODIMENT

Figure 5:
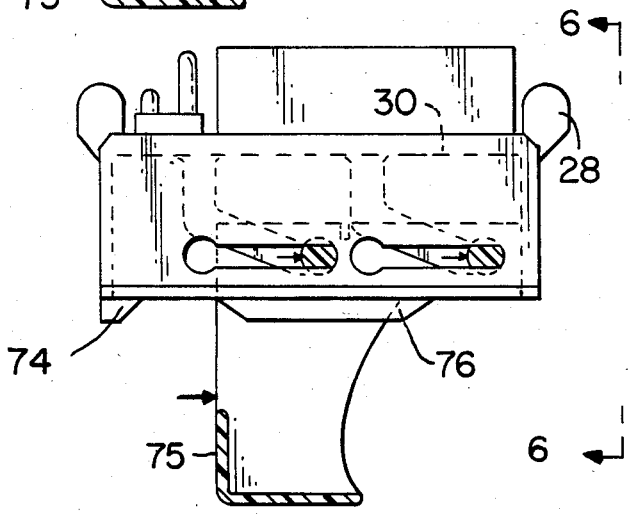

A connector assembly 2 in accordance with the invention comprises first and second housings 4, 6 and a camming slide 8. All of the parts are preferably produced by injection molding, a preferred molding material being a nylon composition containing glass fibers. One material which has been found to be satisfactory is sold under the name Ultramid A3WG6 by BASF of the Federal Republic of Germany. The first housing 4 is generally rectangular and has a mating face 10 (FIG. 6), a rear face 11, upper and lower oppositely facing sidewalls 12, 14, and oppositely facing endwalls 16. Flanges 18 extend beyond the upper and lower sidewalls on each side of the mating face 10 and end flanges 20 extend beyond the endwalls 16. The flanges 18 have ends 19 and free edges 21 which extend between the ends. The flanges 18, 20 form a hood which completely surrounds the mating face and which receives the second housing 6 as shown in FIG. 5.

Figure 2:
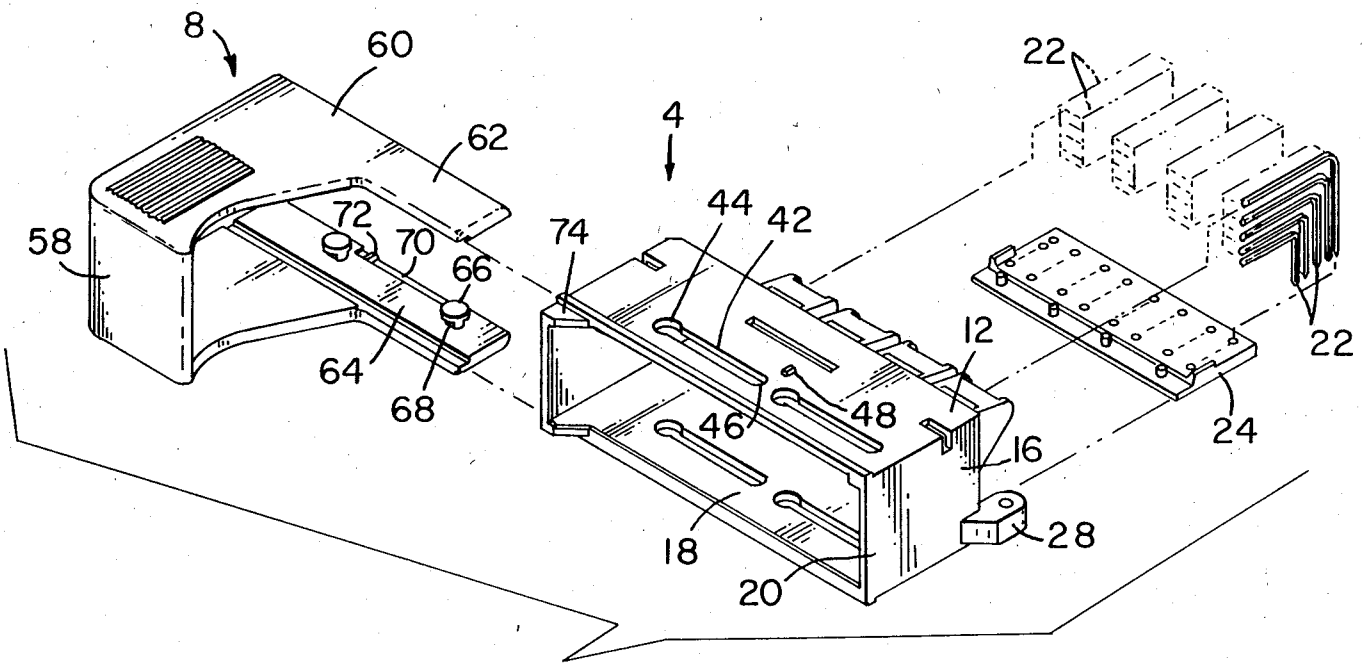
FIG. 2 is a view showing only the first housing and the camming slide.

In the embodiment shown, the first housing contains terminals in the form of terminal pins 22 which extend beyond the mating face and which are bent downwardly at the rear face and extend into a locating plate 24, FIG. 2. The plate 24 is in turn mounted on a circuit board 26 and the housing is secured to the circuit board by fasteners which extend through mounting ears 28.

The second housing 6 has a mating face 30, a rear face 32, upper and lower sidewalls 34, 36, and oppositely facing endwalls 38. The second housing contains terminals (not specifically shown) which are secured to wires 40 that extend beyond the rear face 32 as shown.

The camming system comprises slots 42 in the first housing, cam tracks 50 in the second housing, and cam followers which are mounted on the housing slide. Two aligned slots are provided in each of the upper and lower flanges 18, each slot having a generally circular enlarged end 44 and an opposite end 46 which is not enlarged. A projection 48 is provided on each of the flanges in back of and substantially between the slots for cooperation with a detent-type projection 72 on the slide 8 as will be described below.

Each of the sidewalls 34, 36 of the second housing has two cam tracks 50, each cam track having an entrance portion 52 which extends inwardly from the mating face 30, an intermediate portion 54 which extends diagonally towards the rear face of the second housing, and an inner end portion 56 which extends substantially parallel to the mating face 30.

The camming slide 8 is generally U-shaped having a web 58 and parallel arms 60 which extend from the web. The arms have rightwardly (as viewed in FIG. 2) projecting extensions 62 which have opposed internal surfaces 64 on which the cam followers 66 are provided. These cam followers have cylindrical ends that are dimensioned to fit through the enlarged ends 44 of the slots 42 and have parallel flat surfaces 68 which are of a width slightly less than the width of the slots 42. The slide 8 can thus be assembled to the first housing by moving the slide rightwardly from the position shown in FIG. 2 and flexing the arms outwardly until the cam followers are in alignment with the enlarged ends 44 of the slots 42. The ends of the cam followers will then move through the enlarged ends and the slide will be captured on the first housing. A recessed surface, as shown at 70 in FIG. 2, extends along one side edge of each of the extensions of the arms and projections 72 are provided at the left-hand ends of these recesses. When the slide is assembled to the first housing, the previously identified projection 48 is received in the recess 70 and when the slide is moved to the position shown in FIG. 5, the projection 72 rides over the projection 48 so that the slide is retained in the position of FIG. 5 as will be described below.

Figure 1:
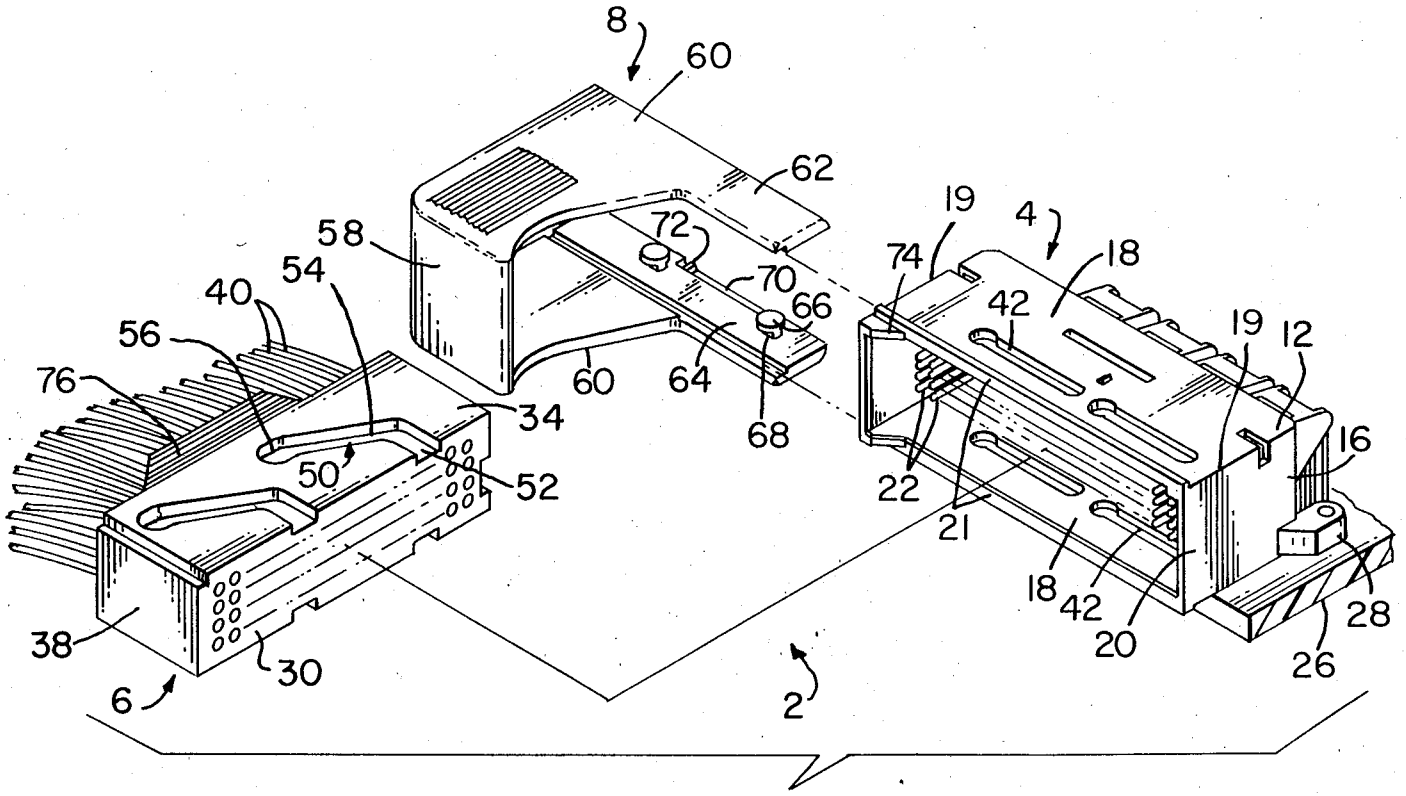
FIG. 1 is a perspective view, with the parts exploded from each other, of a connector assembly in accordance with the invention.
Figure 3:
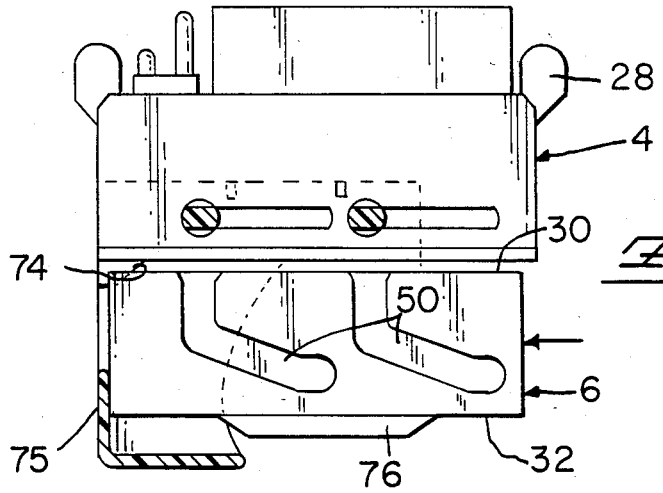
FIG. 3 is a top plan view, partially in section, showing the positions of the parts when the second housing is located in alignment with the first housing in preparation for mating the housings with each other.

In order to assist the technician in mating the second housing with the first housing, locating surfaces are provided as shown at 74, 75 against which the endwall of the second housing is positioned in preparation for mating the two housings with each other. The surfaces 74 extend from the flanges 18 and 20 on the left-hand side of the first housing, as viewed in FIG. 1, and the surface 75 extends between the arms of the camming slide. As shown by FIG. 3, the endwall of the second housing can thus be positioned against these surfaces in preparation for mating the connector housings with each other.

Figure 4:
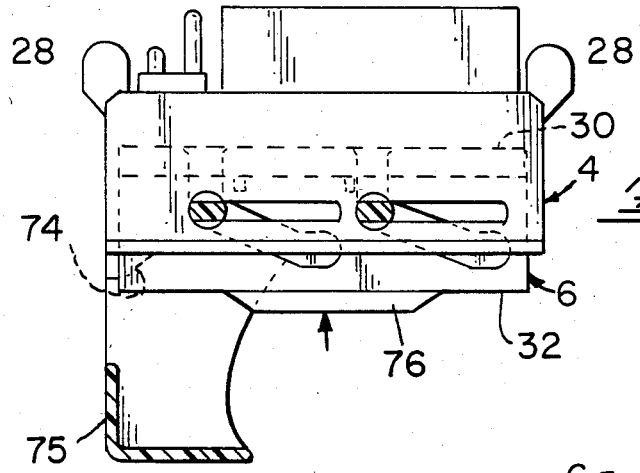
FIGS. 4 and 5 are views similar to FIG. 3 showing the movement of the parts when the housings are mated with each other.

When the housings are to be mated or coupled to each other, the second housing is located, as shown in FIG. 3, in alignment with the first housing and with its endwall against the locating surfaces 74, 75. The technician then moves the second housing inwardly from the position of FIG. 3 so that the cam followers enter the entrance portions 54 of the cam tracks 50. Extensions 76 are provided on the second housing to assist in this operation. After the second housing has been moved to the position of FIG. 4, it is merely necessary for the technician to move the camming slide to the position of FIG. 5. During such movement of the camming slide, the cam followers will move relatively through the intermediate portions of the cam tracks and move the second housing into coupled relationship with the first housing.

An advantageous feature of the invention is that the camming system can be provided on the connector assembly at very little added cost. As noted above, the cam tracks and the slots are on the housings and, because of the fact that the housings are manufactured by injection molding, the only added manufacturing cost in providing these cam tracks and slots is that of manufacturing the molds by which the housings are manufactured. The camming slide is a relatively simple part and can be manufactured at a relatively low cost.

Figure 6:
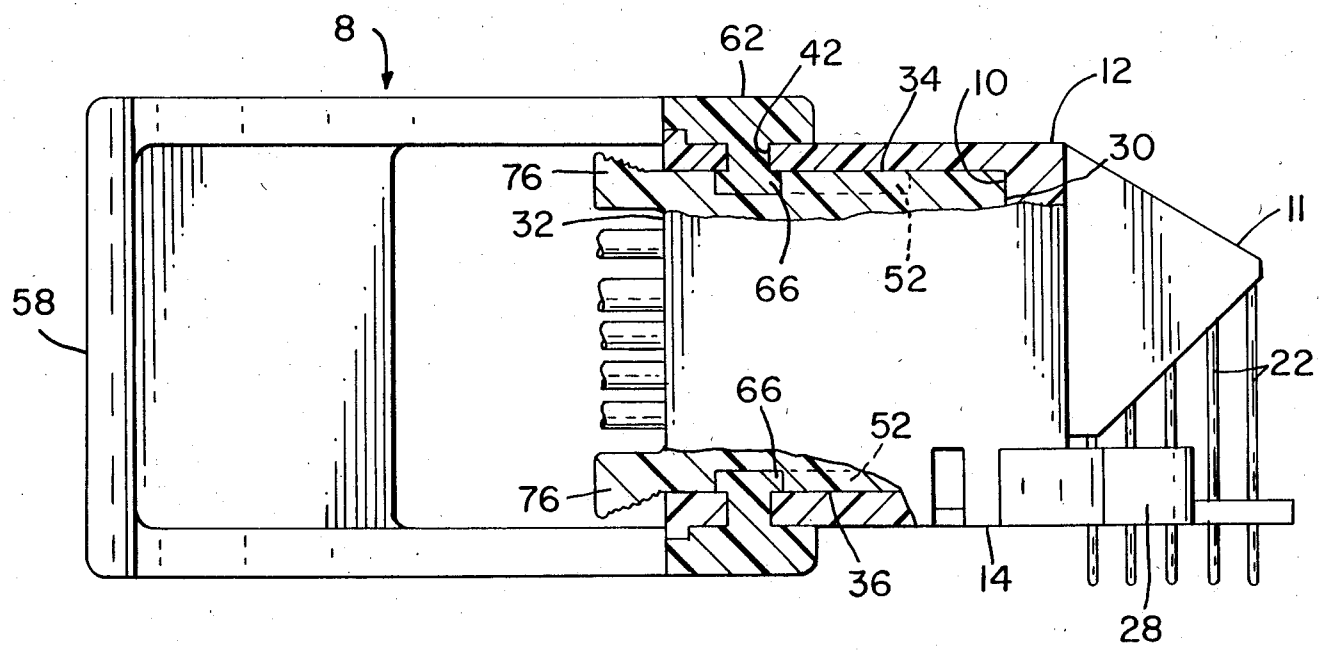
FIG. 6 is a view, partially in section, looking in the direction of the arrow 6—6 of FIG. 5.

A further advantageous feature of the invention is that the camming slide does not extend laterally beyond the endwalls 20, 38 of the housing but rather extends rearwardly beyond the rear wall of the second housing. A connector in accordance with the invention can therefore be mounted in areas where there is limited space available on each side of the connector. There is usually clearance in a connector assembly mounted on a circuit board, as shown in FIGS. 2 and 6, in back of the connector housing which is coupled to the housing which is mounted on the board. On the other hand, it quite often happens that there is not clearance on each side of either of the connector housings.

Connector assemblies in accordance with the invention can be made in any desired size, but the principles of the invention are particularly useful where the connector is of a relatively small size and which must be mounted in a confined area. For example, one connector assembly in accordance with the invention has a width, as measured between the endwalls of the first housing, of 72 mm and is mounted in a confined and inaccessible area in a motor vehicle. The invention is particularly advantageous under such circumstances, that is where the connector is mounted in an inaccessible location, for the reason that mating of the connector parts with each other merely requires the technician to line the parts up with each other, as shown in FIG. 3, and the locating surfaces in the connector assembly ensure that the parts will be aligned with each other even though the operation must be carried out under difficult circumstances. After the parts are aligned, the technician merely moves the camming slide, as shown in FIGS. 4 and 5, and again, this operation can be carried out even if the connector is in an inaccessible area.

It will be apparent from the foregoing description that a connector in accordance with the invention can be produced at low cost and will have all of the advantages of previously known connectors having camming slides.

We claim:

1. An electrical connector assembly of the type comprising first and second connector housings, each of the housings having a plurality of electrical terminals therein and having a mating face, the mating faces of the housings being opposed to each other and being substantially against each other when the housings are coupled, each of the housings having oppositely facing sidewalls and oppositely facing endwalls, and a camming system for moving the housings towards and away from each other along a first path to mate and unmate the housings, the camming system comprising a camming side which is mounted in one of the housings and which is movable along a cam slide path which extends transversely of the first path, the connector assembly being characterized in that:

the first housing has a pair of side flanges extending therefrom on opposite sides of the mating face, the side flanges having ends which are proximate to the endwalls of the first housing and having free edges extending between the ends of the flanges which are spaced outwardly from the mating face of the first housing, the camming slide being U-shaped and comprising a web and spaced-apart arms extending from the web, the camming slide being mounted on the flanges with the arms extending towards, and overlapping the flanges, the second housing having cam tracks in the sidewalls thereof which extend inwardly from the mating face of the second housing, the cam tracks having intermediate portions which extend diagonally towards the rear face of the second housing, the arms having integral cam followers thereon which are received in the cam tracks, the side flanges having slots therein which extend substantially parallel to the mating face of the first housing, the cam follower extending through the slots, the cam follower and the slots constituting interfitting guide means for guiding the cam slide along the cam slidepath, whereby upon positioning the second housing in opposed aligned relationship with the first housing and with the cam followers in the cam tracks, the first and second housings cam be mated to each other by moving the camming slide along the camming slide path.

2. An electrical connector assembly as set forth in claim 1 characterized in that the web of the camming slide is located outwardly from the free edges of the flanges of the first housing, and the second housing is between the web and the first housing.

3. An electrical connector as set forth in claim 1 characterized in that each of the side flanges has two slots therein, each of the arms has two cam followers extending therefrom, and each of the sidewalls of the second housing has two cam tracks.

4. An electrical connector as set forth in claim 3 characterized in that the camming slide has locating surface portions against which the second housing is positioned to locate the second housing in opposed aligned relationship to the first housing.

5. An electrical connector as set forth in claim 4 characterized in that the first housing has end flanges extending from the mating face at the ends thereof, the end flanges and the side flanges forming a hood which surrounds the mating face of the first housing, the second housing being received in the hood when the first housing and the second housing are mated.

6. An electrical connector assembly as set forth in claim 2 characterized in that the camming slide has locating surface portions against which the second housing is positioned to locate the second housing in opposed aligned relationship with the first housing.

7. An electrical connector assembly as set forth in claim 6 characterized in that the locating surface portions are integral with the arms and the web and extend transversely of the planes defined by the arms and the web.

8. An electrical connector assembly as set forth in claim 1 characterized in that the first and second housings and the camming slide are of molded plastic material.

* * * * *